US005687659A

United States Patent [19]

Matsunaga et al.

[11] Patent Number: 5,687,659

[45] Date of Patent: Nov. 18, 1997

[54] WORK-SHEET PRESSING APPARATUS FOR SEWING MACHINE

[75] Inventors: Hirokazu Matsunaga, Tajimi; Yuji Tagawa, Nagoya, both of Japan

[73] Assignee: Brother Kogyo Kabushiki Kaisha, Nagoya, Japan

[21] Appl. No.: 600,282

[22] Filed: Feb. 12, 1996

[30] Foreign Application Priority Data

Feb. 14, 1995 [JP] Japan ..... 7-025629

[51] Int. Cl.[6] ..... D05B 19/12; D05B 29/02

[52] U.S. Cl. ..... 112/470.01; 112/239

[58] Field of Search ..... 112/470.06, 470.01, 112/102.5, 103, 235, 239, 311

[56] References Cited

U.S. PATENT DOCUMENTS

| | | | |
|---|---|---|---|
| 4,455,956 | 6/1984 | Yamamoto et al. | 112/470.06 X |
| 4,587,911 | 5/1986 | Kinoshita | 112/239 |
| 4,676,179 | 6/1987 | Nomura et al. | 112/239 |

FOREIGN PATENT DOCUMENTS 3-28957 4/1991 Japan .

*Primary Examiner*—Peter Nerbun
*Attorney, Agent, or Firm*—Oliff & Berridge

[57] ABSTRACT

An apparatus for moving a work-sheet pressing member of a sewing machine relative to a work-sheet supporting member to press a work sheet on the work-sheet supporting member, the apparatus including a biasing device which produces a biasing force to move the work-sheet pressing member in a downward direction toward the work-sheet supporting member, a solenoid which moves, against the biasing force, the work-sheet pressing member in an upward direction away from the work-sheet supporting member, a control device which controls an energization of the solenoid so that the work-sheet pressing member is moved in the downward and upward directions, a detector which provides a detection signal indicating that the work-sheet pressing member is moved in the downward direction to a braking position which is predetermined relative to the work-sheet supporting member, the control device receiving the detection signal from the detector, and the control device controlling the solenoid such that, when the control device receives the detection signal during the downward movement of the work-sheet pressing member, the solenoid reduces a speed of the downward movement of the work-sheet pressing member.

20 Claims, 5 Drawing Sheets

FIG. 5
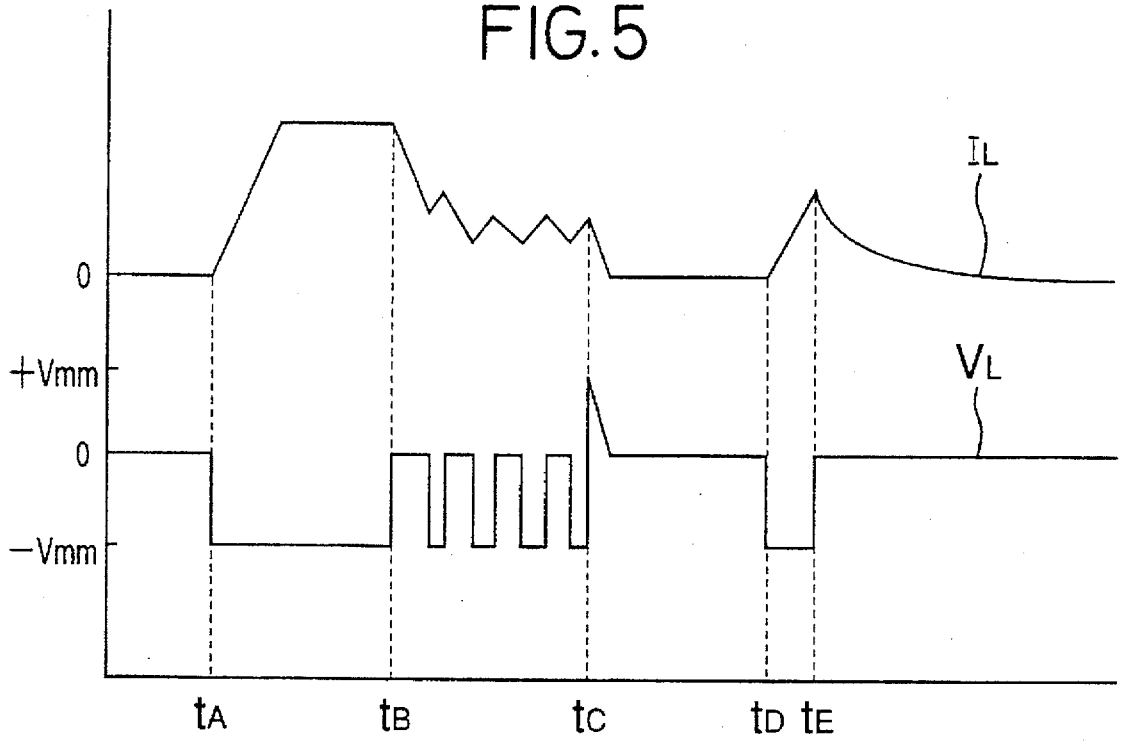
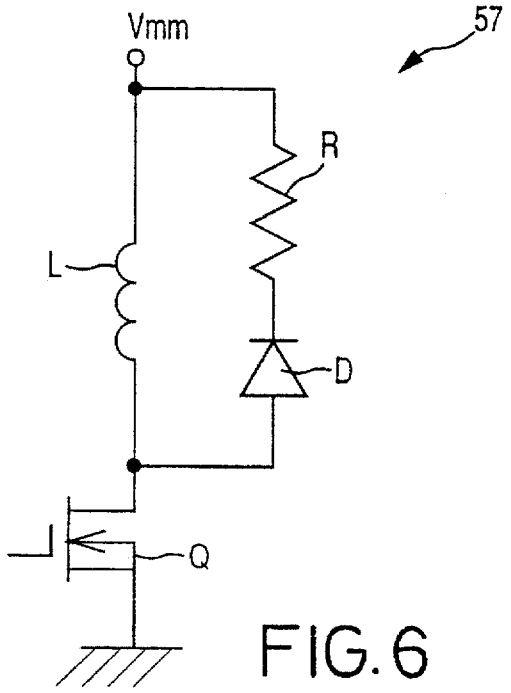
FIG. 6

WORK-SHEET PRESSING APPARATUS FOR SEWING MACHINE

BACKGROUND OF THE INVENTION

1. Field of the Invention

The present invention relates to a work-sheet pressing apparatus which employs a solenoid for moving a work-sheet pressing member of a sewing machine in an upward and a downward direction so as to press a work sheet such as a cloth or a piece of leather.

2. Related Art Statement

There is known a sewing machine which employs a solenoid for moving a work-sheet pressing member upward and downward. In the sewing machine, however, if the work-sheet pressing member is quickly moved downward, then the pressing member collides with a work-sheet supporting member such as a throat plate or an upper surface of a bed portion of the sewing machine. Consequently the pressing member, the supporting member, or the work sheet may be damaged, or a great sound or noise may be produced from the collision.

In the above background, Japanese Patent Application laid open for opposition under Publication No. 3(1991) 28957 discloses a work-sheet pressing device which brakes midway during the downward movement of a work-sheet pressing member. The work-sheet pressing device moves the work-sheet pressing member downward, by first deenergizing a solenoid for a predetermined duration of time so as to permit the pressing member to be moved downward quickly in the time duration, and subsequently repeating the energization and deenergization of the solenoid at a predetermined ratio of the former to the latter so as to permit the pressing member to be moved downward slowly.

However, the above-indicated work-sheet pressing device suffers from the problem that identical work-sheet pressing devices or machines that have the same construction may not move respective work-sheet pressing members downward, at the same speed, because of various differences present between or among them. Those differences may result from, e.g., the change of resistance of each solenoid due to heating thereof, or the change of electric voltage of each solenoid drive power source, or may be the difference of respective frictional resistances of movable elements due to assembly errors or aged deterioration. Therefore, the prior work-sheet pressing device may not brake the downward movement of the work-sheet pressing member at an appropriate position relative to the work-sheet supporting member or the work sheet after the pressing device has moved the pressing member downward for the predetermined duration of time. In some cases, a great impact noise is produced. On the other hand, if the identical pressing devices are adapted to brake the respective downward movements after a shortened duration of time, for the purpose of compensating for the differences of the individual pressing devices or machines, the pressing members are moved downward slowly for a prolonged duration of time. Accordingly, the operation efficiency is lowered.

SUMMARY OF THE INVENTION

It is therefore an object of the present invention to provide a work-sheet pressing apparatus which brakes a downward movement of a work-sheet pressing member of a sewing machine, at a predetermined position, thereby effectively preventing the pressing member from colliding with a work-sheet supporting member such as a throat plate.

The above object has been achieved according to the present invention, which provides an apparatus for moving a work-sheet pressing member of a sewing machine relative to a work-sheet supporting member to press a work sheet on the work-sheet supporting member, the apparatus comprising a biasing device which produces a biasing force to move the work-sheet pressing member in a downward direction toward the work-sheet supporting member, a solenoid which moves, against the biasing force, the work-sheet pressing member in an upward direction away from the work-sheet supporting member, a control device which controls an energization of the solenoid so that the work-sheet pressing member is moved in the downward and upward directions, a detector which provides a detection signal indicating that the work-sheet pressing member is moved in the downward direction to a braking position which is predetermined relative to the work-sheet supporting member, the control device receiving the detection signal from the detector, and the control device controlling the solenoid such that, when the control device receives the detection signal during the downward movement of the work-sheet pressing member, the solenoid reduces a speed of the downward movement of the work-sheet pressing member.

In the work-sheet pressing apparatus constructed as described above, when the work-sheet pressing member is moved in the downward direction to the braking position, the detector produces the detection signal indicative of the fact and, when the control device receives the detection signal from the detector, the control device controls the solenoid to brake the downward movement of the work-sheet pressing member. Thus, in the present apparatus, the braking position where the braking operation begins does not change. Accordingly, the present apparatus is free from the problem that the downward movement of the pressing member is braked before the pressing member is moved downward by an appropriate amount or the problem that the downward movement of the pressing member is braked after the pressing member is moved downward by too much an amount. Therefore, even if identical work-sheet pressing apparatus may move respective work-sheet pressing members downward at different speeds because of the differences of the individual apparatus or the aged deterioration of each apparatus, the pressing apparatus are free from the problem of occurrence of collision or the problem of deteriorated operation efficiency.

According to a preferred feature of the present invention, the control device comprises a deenergizing device which deenergizes the solenoid and thereby permits the work-sheet pressing member to be moved in the downward direction because of the biasing force of the biasing device. In this case, the work-sheet pressing member may be moved downward quickly. If the speed of downward movement of the pressing member is too fast, a small current may be applied to the solenoid for the purpose of controlling the increasing of the downward movement speed. In the latter case, however, the operation efficiency on the downward movement of the pressing member is lowered. Hence, in the case where the pressing member is braked so effectively as to avoid collision, after being moved downward as quickly as possible, the operation efficiency is maximized.

According to another feature of the present invention, the control device comprises a switching device which, when the control device receives the detection signal, energizes the solenoid, subsequently deenergizes the solenoid, and repeats the energization and deenergization of the solenoid by a predetermined number of times. In this case, an electric current flowing through the solenoid changes depending upon the ratio of energization (ON) time to deenergization (OFF) time. Accordingly, the force to move the work-sheet pressing member upward can be controlled by adjusting this ratio. Therefore, if the solenoid is iteratively energized and deenergized at an appropriate time ratio counterbalancing the biasing force to move the pressing member downward, the pressing member can be moved downward slowly, so that the pressing member does not collide with the work-sheet supporting member.

According to another feature of the present invention, the switching device comprises energization changing means for energizing the solenoid for a first ON time at at least one time immediately after the control device receives the detection signal, and energizing the solenoid for a second ON time shorter than the first ON time, at at least one time following the at least one time immediately after the control device receives the detection signal. In this case, a duty ratio of an ON time to an OFF time may gradually be reduced. At any rate, the solenoid is energized and deenergized so that a drive current flowing through the solenoid gradually decreases though it may instantaneously increase.

According to another feature of the present invention, the energization changing means comprises means for energizing the solenoid for a predetermined first ON time at at least one time immediately after the control device receives the detection signal, and energizing the solenoid for a predetermined second ON time at each of subsequent times following the at least one time, the first ON time being longer than the second ON time. The work-sheet pressing member may have a considerably large inertia in the downward direction when the downward movement thereof is braked by the control device. If the downward movement of the pressing member is controlled at a considerably large duty cycle, i.e., ratio of an ON time to an OFF time of the solenoid, the downward movement of the pressing member can effectively be braked, but the pressing member may "bounce" on the work-sheet supporting member after it contacts the supporting member. On the other hand, if the duty cycle is considerably small, the downward movement of the pressing member may not effectively be braked and the pressing member may collide with the supporting member. In this preferred embodiment of the invention, however, the solenoid is energized for the long, first ON time at one or more times or cycles immediately after the control device receives the detection signal, the first ON time being longer than the second ON time and having a sufficient length to offset or cancel the downward-direction inertia of the pressing member. Thus, the downward movement of the pressing member is effectively braked by, e.g., only the first energization of the solenoid, and then the pressing member is moved downward at a reduced speed by energizing the solenoid for the appropriately short, second ON time at each of the subsequent times or cycles. Therefore, the work-sheet pressing apparatus in accordance with the present preferred embodiment is free from the above-identified problems that the pressing member may bounce on the work-sheet supporting member after it contacts the supporting member and that the pressing member may collide with the supporting member. Accordingly, the braking position may be determined at a position which is as low as possible, i.e., as near as possible to the supporting member. Otherwise, the biasing force of the biasing device may be selected at as large as possible a value, and the efficiency of the downward movement of the pressing member is much improved.

According to another feature of the present invention, the control device comprises a solenoid drive circuit which drives the solenoid, the drive circuit comprising an electric power source and a switching element which are connected to the solenoid, the switching device comprising the switching element.

According to another feature of the present invention, the control device comprises a solenoid drive circuit which drives the solenoid, the drive circuit comprising an electric power source, a first switching element connected at a first terminal thereof to ground and at a second terminal thereof to the solenoid, a second switching element connected at a first terminal thereof to said power source and at a second terminal thereof to the solenoid, a first rectifying element connected at a first terminal thereof to the first terminal of the first switching element and at a second terminal thereof to the second terminal of the second switching element, and a second rectifying element connected at a first terminal thereof to the first terminal of the second switching element and at a second terminal thereof to the second terminal of the first switching element.

According to another feature of the present invention, the control device comprises means for deenergizing the solenoid by placing each of the first and second switching elements in an OFF state thereof, and means for, when the control device receives the detection signal, energizing the solenoid by placing each of the first and second switching elements in an ON state thereof for a predetermined ON time, and subsequently placing one of the first and second switching elements in an OFF state thereof while maintaining the other switching element in the ON state thereof. Thus, the downward movement of the work-sheet pressing member is braked and the speed thereof is reduced.

According to another feature of the present invention, the detector comprises a movable member which is moved together with the work-sheet pressing member when the pressing member is moved in the downward direction, and a non-contact switch which identifies, without mechanically contacting the movable member, that the movable member is moved to a predetermined switching position corresponding to the braking position. In this case, the movable member may comprise a shutter member which is moved together with the work-sheet pressing member when the pressing member is moved in the downward direction, and the non-contact switch comprises a photointerrupter which includes a light emitter for emitting a light, and a light receiver for receiving the light emitted from the light emitter, wherein when the shutter member is moved to the predetermined switching position corresponding to the braking position, the shutter member interrupts the light emitted from the light emitter toward the light receiver, so that the photointerrupter produces the detection signal. The photointerrupter is available at low cost.

According to another feature of the present invention, the detector comprises a movable member which is moved together with the work-sheet pressing member when the pressing member is moved in the downward direction, and a contact switch which identifies, by mechanically contacting the movable member, that the movable member is moved to a predetermined switching position corresponding to the braking position. The contact switch may be a limit switch.

According to another feature of the present invention, the work-sheet pressing apparatus further comprises an arm member and an axis member about which the arm member is rotatable, the work-sheet pressing member being supported by the arm member.

According to another feature of the present invention, the biasing device comprises a coil spring which is connected to the arm member.

According to another feature of the present invention, the arm member includes two arm portions located on both sides of the axis member and the work-sheet pressing member is supported by one of the two arm portions of the arm member, and wherein the coil spring comprises a compression coil spring connected to the other arm portion of the arm member.

According to another feature of the present invention, the coil spring comprises a tension coil spring which is connected to the arm member at an intermediate position between a position of provision of the axis member and a position where the work-sheet pressing member is supported by the arm member.

According to another feature of the present invention, the work-sheet pressing apparatus further comprises a link mechanism which connects the arm member to the solenoid, the link mechanism comprising a direction-changing mechanism including a first link member which is rotatable about a fixed rotation axis, a second link member which is connected to the first link member such that the second link member is rotatable relative to the first link member, about a first movable rotation axis located away from the fixed rotation axis, and a third link member which is connected to at least one of the first and second link members such that the third link member is rotatable relative to the at least one of the first and second link members, about a second movable rotation axis, the second link member being rotatably connected to the arm member, the first and second link members being connected to each other so as to contain an obtuse angle inside of which the third link member extends in a direction substantially perpendicular to a straight line connecting between the fixed rotation axis and an end of the second link member at which the second link member is rotatably connected to the arm member, wherein the solenoid comprises a coil and a plunger which is electromagnetically moved relative to the coil when the coil is energized by the control device, the third link member being rotatably connected to the plunger. In this case, the first and second movable rotation axes may coincide with each other.

According to another feature of the present invention, the link mechanism further comprises a guide member and a fourth link member which is rotatably connected at one of opposite ends thereof to the second link member, is rotatably connected at the other end thereof to the arm member, and is moved with the second link member by being guided by the guide member. In this case, a fifth link member may be provided between the fourth link member and the arm member.

According to another feature of the present invention, the detector comprises a movable member which is moved together with one of the first, second, third, and fourth link members when the work-sheet pressing member is moved in the downward direction, and a switch which identifies that the movable member is moved to a predetermined switching position corresponding to the braking position.

According to another feature of the present invention, the work-sheet pressing apparatus further comprises a link mechanism which connects the arm member to the solenoid, the link mechanism comprising a toggle mechanism including a first link member which is rotatable about a fixed rotation axis, a second link member which is connected to the first link member such that the second link member is rotatable relative to the first link member, about a first movable rotation axis located away from the fixed rotation axis, and a third link member which is connected to at least one of the first and second link members such that the third link member is rotatable relative to the at least one of the first and second link members, about a second movable rotation axis, the second link member being rotatably connected to the arm member, the first and second link members being connected to each other so as to contain an obtuse angle which is reduced when the solenoid is energized, the third link member extending in a direction substantially perpendicular to a straight line connecting between the fixed rotation axis and an end of the second link member at which the second link member is rotatably connected to the arm member, wherein the solenoid comprises a coil and a plunger which is electromagnetically moved relative to the coil when the coil is energized by said control device, the third link member being rotatably connected to the plunger. In this case, a considerably small electromagnetic force can move the plunger, thereby moving the work-sheet pressing member in the upward direction against the biasing force of the biasing device.

According to another feature of the present invention, the work-sheet pressing apparatus further comprises an input device which is operable for inputting a command to move the work-sheet pressing member in the downward direction.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 5 is a time chart representing respective changes of a drive current and a potential difference across a solenoid of the solenoid drive circuit of FIG. 3;

FIG. 6 is a diagrammatic view of another solenoid drive circuit of another work-sheet pressing apparatus as a second embodiment of the present invention.

DETAILED DESCRIPTION OF THE PREFERRED EMBODIMENTS

Figure 1:
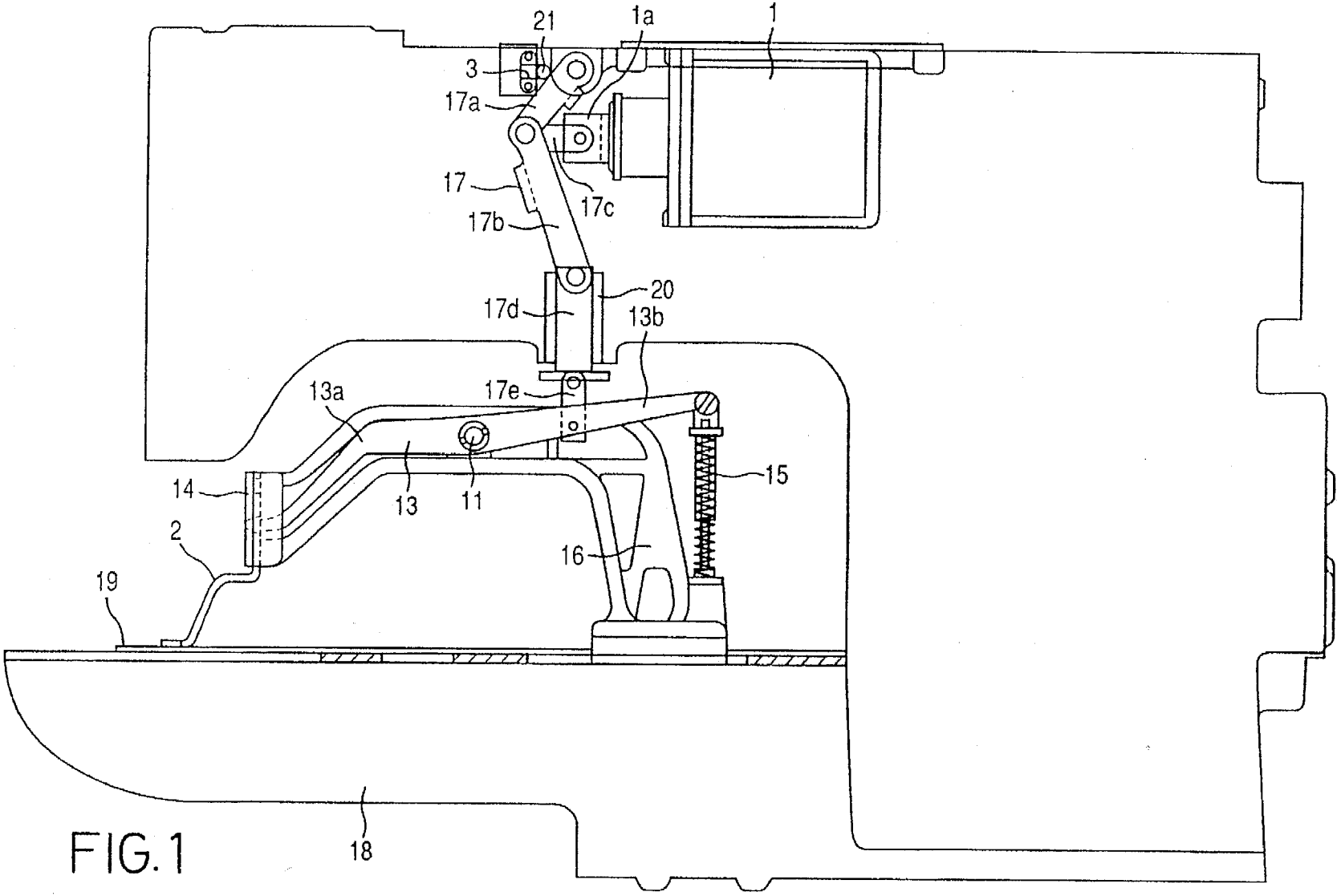
FIG. 1 is a schematic view of a sewing machine including a work-sheet pressing apparatus to which the present invention is applied.

Referring to FIG. 1, there is shown a sewing machine including a work-sheet pressing apparatus to which the present invention is applied.

In FIG. 1, reference numeral 2 designates two work-sheet pressing members (only one is shown) for pressing one or more work sheets, such as a fabric or a piece of leather. The two pressing members 2 may be replaced by a single pressing member. The two pressing members 2 are supported by respective ends (i.e., left-hand ends) of respective left arm portions 13*a* of two arm members 13 (only one is shown) which are rotatable about a fixed axis member 11. Each pressing member 2 has, in an upper end portion thereof, an insertion hole through which one end of the left arm portion 13*a* of a corresponding arm member 13 is inserted, and the upper end portion of each pressing member 2 is guided in a corresponding one of two guide grooves provided in a guide member 14 supported by a left-hand end of a guide-member supporting member 16. After each pressing member 2 is fit in the corresponding guide groove with the left-hand end of the corresponding arm member 13 being inserted through the insertion hole of each pressing member 2, a lid member 14*a* is detachably attached to the guide member 14 to cover the two guide grooves. Each pressing member 2 is movable within a predetermined range having an upper and a lower limit which are defined by an upper and a lower horizontally extending bars of the guide member 14.

When the arm members 13 are rotated in a clockwise or a counterclockwise direction about the axis member 11, the pressing members 2 are moved upward or downward, respectively. A biasing spring, i.e., compression coil spring 15 is connected to a connection pin which connects between respective ends (i.e., right-hand ends) of respective right arm portions 13*b* of the two arm members 13. When the arm members 13 are rotated clockwise about the axis member 11, the biasing spring 15 is elastically compressed under the right arm portions 13*b* so that the spring 15 stores an elastic force to rotate the right arm portions 13*b* or the whole arm members 13 counterclockwise, i.e., downward. The arm members 13 are connected via a link mechanism 17 to a solenoid 1 which, upon energization, rotates the arm members 13 clockwise, i.e., upward, thereby moving the work-sheet pressing member 2 away from a throat plate 19 or an upper surface of a sewing bed 18.

The link mechanism 17 includes five link members 17*a*, 17*b*, 17*c*, 17*d*, 17*e*. The first link member 17*a* is rotatable about a fixed rotation axis, the second link member 17*b* is connected to the first link member 17*a* such that the second link member 17*b* is rotatable relative to the first link member 17*a*, about a first movable rotation axis located away from the fixed rotation axis, and the third link member 17*c* is connected to the first and second link members 17*a*, 17*b* such that the third link member 17*c* is rotatable relative to each of the first and second link members 17*a*, 17*b*, about the movable rotation axis. The first and second link members 17*a*, 17*b* are connected to each other so as to contain an obtuse angle inside of which the third link member 17*c* extends in a direction substantially perpendicular to a straight line connecting between the fixed rotation axis and an end of the second link member 17*b*. That end of the second link member 17*b* is rotatably connected to the fourth link member 17*d*, which is rotatably connected to the fifth link member 17*e* which in turn is rotatably connected to a connection pin which connects between the respective right arm portions 13*b* of the two arm members 13. The connection pin is movable with the arm members 13, upward and downward, within a hole formed through the thickness of the guide-member supporting member 16. The fourth link member 17*d* is guided by a link guide member 20 fixed to a frame member of the sewing machine, such that the link member 17*d* is movable in a vertical direction. The third link member 17*c* is rotatably connected to a plunger 1*a* which is electromagnetically moved relative to a coil (not shown) of the solenoid 1.

A shutter member 21 is fixed to the first link member 17*a* of the link mechanism 17. When the shutter 21 is moved with the movement of the link mechanism 17 in a leftward direction and cuts an optical path between a light emitting member and a light receiving member (not shown) of a photointerrupter 3 which are opposed to each other in a horizontal direction, the photointerrupter 3 is turned OFF.

FIG. 1 shows the solenoid 1 being placed in a deenergized state thereof. In this state, the arm members 13 are biased counterclockwise by the elastic force of the spring 15, and the work-sheet pressing members 2 are biased to press the work sheet or sheets against the throat plate 19. Also, in this state, the shutter member 21 is positioned between the light emitter and light receiver of the photointerrupter 3, i.e., is cutting the optical path from the light emitter to the light receiver, so that the photointerrupter 3 is placed in the OFF state thereof.

Upon application of electric power to the solenoid 1, the solenoid 1 is energized and moves the third link member 17*c* of the link mechanism 17 in the rightward direction. More specifically described, the "angled" first and second link members 17*a*, 17*b* of the link mechanism 17 are moved rightward and are "extended" straightly and vertically, so that the fourth link member 17*d* is moved downward and a lower end of the fifth link member 17*e* connected to the right arm portions 13*b* rotates the arm members 13 clockwise. Consequently the work-sheet pressing members 2 are moved upward away from the upper surface of the throat plate 19. In addition, since the first link member 17*a* is moved rightward, the shutter member 21 comes out of the optical path between the light emitter and light receiver of the photointerrupter 3, so that the photointerrupter 3 is turned ON. The present work-sheet pressing apparatus is designed such that the timing when the photointerrupter 3 is turned from the OFF state to the ON state, or vice versa, corresponds to the timing when the pressing members 2 are moved to a predetermined braking position at a small distance away from the upper surface of the throat plate 19.

Figure 2:
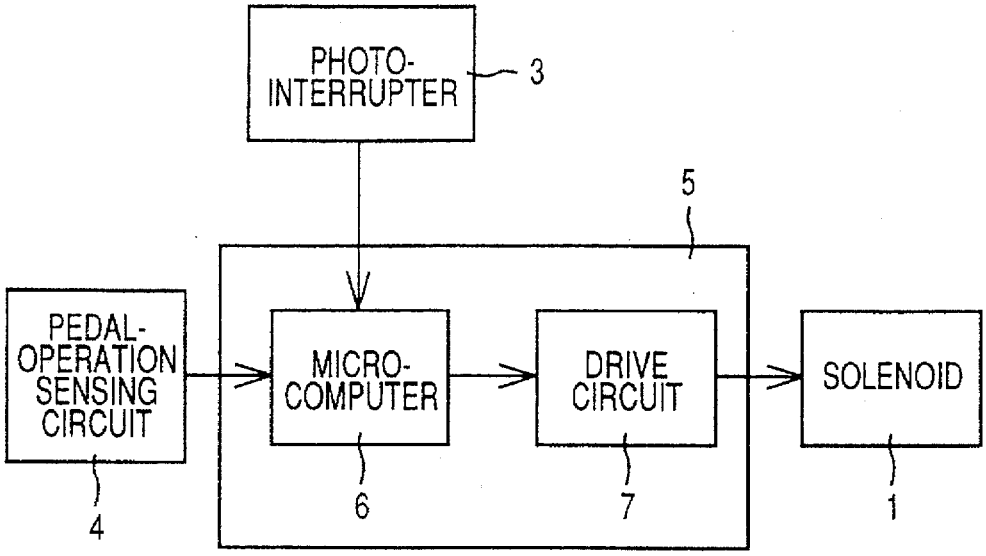
FIG. 2 is a block diagram of an electric arrangement the work-sheet pressing apparatus of FIG. 1.

As shown in FIG. 2, the present work-sheet pressing apparatus includes a pedal-operation sensing circuit 4, and a control box 5 to which the sensing circuit 4 and the photointerrupter 3 are connected. When a user steps on a pedal (not shown), the sensing circuit 4 generates an upward-movement command signal to command an upward movement of the work-sheet pressing members 2. On the other hand, when the user releases his or her foot from the pedal, the sensing circuit 4 generates a downward-movement command signal to command a downward movement of the pressing members 2. The control box 5 includes a microcomputer (MC) 6 which receives input signals supplied from the photointerrupter 3 and the sensing circuit 4 and which controls respective operations of various elements of the sewing machine. The control box 5 additionally includes a solenoid drive circuit (DR) 7 which receives a command signal supplied from the computer 6 and, based on the received signal, supplies a drive current (direct current) to the solenoid 1 or cuts the supplying of drive current to the solenoid 1.

Figure 3:
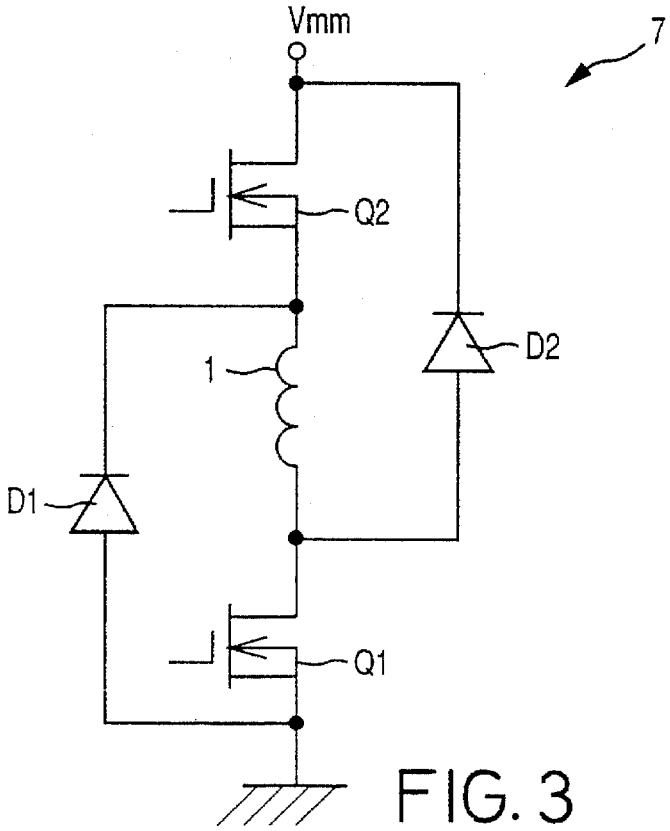
FIG. 3 is a diagrammatic view of a solenoid drive circuit of the work-sheet pressing apparatus of FIG. 2.

As shown in FIG. 3, the solenoid drive circuit 7 includes an electric power source, $V_{mm}$, a first and a second switching elements, Q1, Q2, and a first and second rectifying element D1, D2. The first switching element Q1 is connected at a first terminal thereof to ground and at a second terminal thereof to the solenoid 1, the second switching element Q2 is connected at a first terminal thereof to the power source $V_{mm}$ and at a second terminal thereof to the solenoid 1, the first rectifying element, i.e., first diode D1 is connected at a first terminal thereof to the first terminal of the first switching element Q1 and at a second terminal thereof to the second terminal of the second switching element Q2, and the second rectifying element, i.e., second diode D2 is connected at a first terminal thereof to the first terminal of the second switching element Q2 and at a second terminal thereof to the second terminal of the first switching element Q1. Each of the switching elements Q1, Q2 is switched ON and OFF under control of the computer 6. The upward and downward movements of the work-sheet pressing members 2 are carried out by changing the combinations of ON and OFF states of the two switching elements Q1, Q2, in a manner described below.

Figure 4:
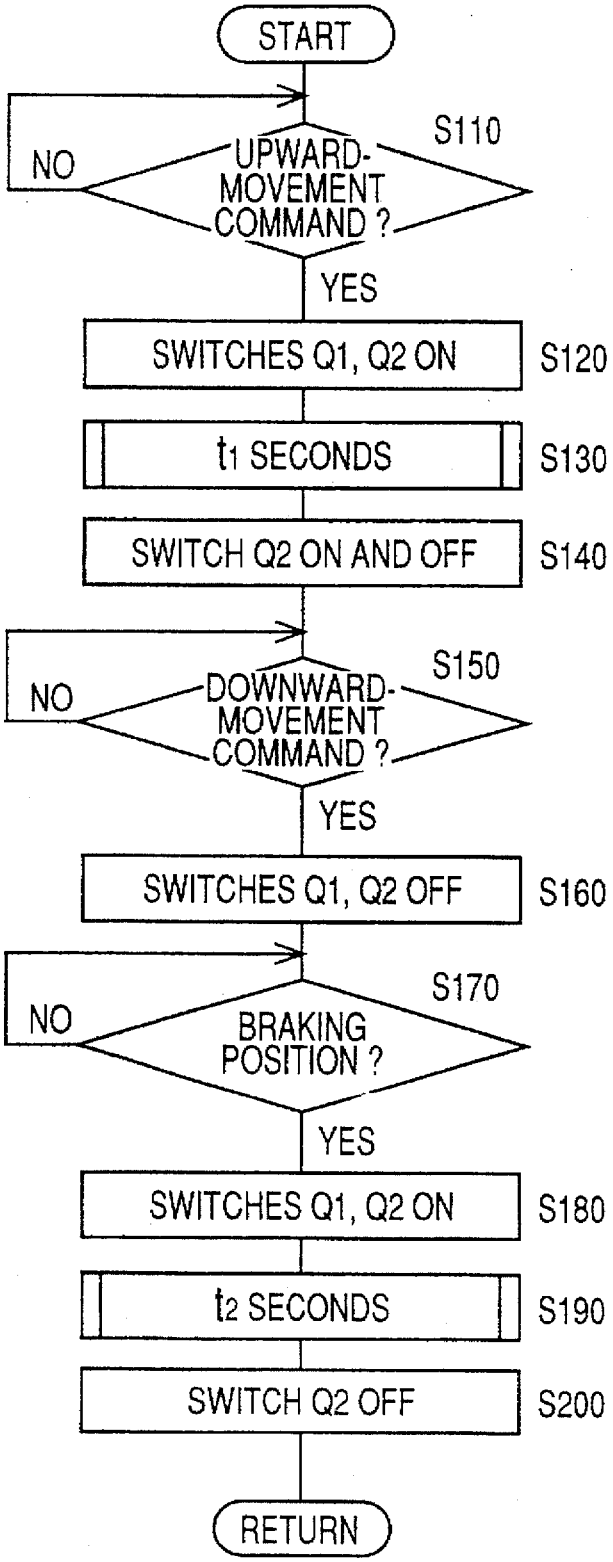
FIG. 4 is a flow chart representing a control program according to which an upward and a downward movement of a work-sheet pressing member are controlled.

Next, there will be described the operation of the computer 6 for controlling the upward and downward movements of the work-sheet pressing members 2, by reference to the flow chart of FIG. 4.

First, at Step S110, the computer 6 judges whether the computer 6 has received the upward-movement command signal from the sensing circuit 4 as a result of user's pushing of the pedal. If a positive judgment is made at Step S110, the control of the computer 6 proceeds with Step S120 at which the computer 6 switches each of the first and second switching elements Q1, Q2 to the ON state. In the solenoid drive circuit 7, a drive current, $I_L$, flows from the power source $V_{mm}$ to the ground via the second switching element Q2, the solenoid 1, and the first switching element Q1 in the order of description. Consequently the solenoid 1 is quickly energized and the work-sheet pressing elements 2 are moved upward until the plunger la is moved to, and stopped at, the most right, i.e., retracted position thereof. Step S120 is followed by Step S130 to judge whether a predetermined time duration, $t_1$ seconds, has passed since the two switching elements Q1, Q2 are switched ON at Step S120. This judgement is made based on a time measured by a timer incorporated in the computer 6. If a positive judgment is made at Step S130, the control of the computer 6 goes to Step S140 to iteratively switch the second switching element ON and OFF at regular intervals of time, i.e., chop the drive current $I_L$ at a predetermined frequency or duty cycle. A large drive current $I_L$ is needed for quickly moving up the pressing member 2s. Once the pressing member 2 is moved up to an upper position thereof corresponding to the retracted position of the plunger 1*a* of the solenoid 1, the pressing members 2 can be sustained at the upper position even if the drive current $I_L$ is cut at an appropriate duty cycle. This arrangement leads to reducing the amount of consumption of electric power.

Step S140 is followed by Step S150 to judge whether the computer 6 has received the downward-movement command signal from the sensing circuit 4 as a result of releasing of user's foot from the pedal. If a positive judgment is made at Step S150, the control of the computer 6 proceeds with Step S160 to switch each of the two switching elements Q1, Q2 to the OFF state. Accordingly, a potential difference, $V_L$, across the solenoid 1 instantaneously increases up to substantially the same level as the potential difference $V_{mm}$ between the power source $V_{mm}$ and the ground. Consequently the drive current $I_L$ flows from the Q1-side terminal of the solenoid 1 to the Q2-side terminal of the solenoid 1 via the second diode D2, the power source $V_{mm}$, the ground, and the first diode D1. Since the potential difference $V_L$ across the solenoid 1 is considerably large, the electric energy of the solenoid 1 quickly dissipates and the drive current $I_L$ instantaneously decreases down to zero. Thus, the solenoid 1 is quickly brought into the deenergized state, and the work-sheet pressing members 2 begin to move downward. Since the two diodes D1, D2 as the rectifying elements are provided, the drive current $I_L$ does not flow in the reverse direction although it may decrease to zero.

When the work-sheet pressing members 2 are moved downward to the braking position and accordingly the photointerrupter 3 is turned OFF, a positive judgment is made at Step S170. Thus, the control of the computer 6 goes to Step S180 to switch each of the two switching elements Q1, Q2 to the ON state. Consequently the drive current $I_L$ flows from the power source $V_{mm}$ to the ground via the switching element Q2, the solenoid 1, and the switching element Q1 in the order of description. The solenoid 1 is quickly placed in the energized state, and the downward movement of the pressing member 2 is braked, that is, the speed of the downward movement is reduced.

Step S180 is followed by Step S190 to wait for a predetermined time duration, $t_2$ seconds, to elapse from the beginning of the braking operation at Step S180. This waiting is carried out according to a time measured by the timer incorporated in the computer 6. After the time duration $t_2$, the control of the computer 6 goes to Step S200 to switch the second switching element Q2 to the OFF state while maintaining the first switching element Q1 in the 0N state. Thus, the potential difference $V_L$ across the solenoid 1 is changed to be equal to a forward voltage, $V_F$, of the first diode D1. Thus, the electric energy of the solenoid 1, i.e., the drive current $I_L$ gradually dissipates and reduces to zero while circulating through the loop comprised of the solenoid 1, the first switching element Q1, the first diode D1, and the solenoid 1 in the order of description. Accordingly, the solenoid 1 is gradually deenergized and the work-sheet pressing members 2 are slowly moved downward.

The timing chart shown in FIG. 5 represents the respective time-wise changes of the drive current $I_L$ and the potential difference $V_L$ across the solenoid 1 when the upward and downward movements of the work-sheet pressing members 2 are carried out under control of the computer 6. The potential difference $V_L$ across the solenoid 1 is expressed by a relative potential value with respect to the potential of the Q2-side (i.e., upper-side) terminal of the solenoid 1 taken as a reference potential. When the potential of the Q2-side terminal of the solenoid 1 is lower than that of the Q1-side terminal of the same 1, the potential difference $V_L$ takes a positive value and, when the former is higher than the latter, the parameter $V_L$ takes a negative value.

When the upward-movement signal is generated from the pedal-operation sensing circuit 4 and the two switching elements Q1, Q2 are turned ON, at a time of $t_A$ in the timing chart of FIG. 5, the potential difference $V_L$ across the solenoid 1 changes to a value, $-V_{mm}$, equal to the difference between the respective potentials of the ground and the power source $V_{mm}$. Thus, the drive current $I_L$ quickly increases and the pressing member 2 moves in the upward direction.

Subsequently, after the time duration of $t_1$seconds elapses and the upward movement of the pressing member 2 is stopped when the plunger la of the solenoid 1 is moved to the retracted position thereof, the voltage-chopping control of the second switching element Q2 is commenced at a time of $t_B$ ($t_B=t_A+t_1$). Thus, the potential difference $V_L$ of the solenoid 1 alternately and iteratively takes the first value of $-V_{mm}$ corresponding to the ON state of the switching element Q2 and the second value of $+V_F$ (equal to the forward voltage of the diode D1) corresponding to the OFF state of the switching element Q2. That is, microscopically, the drive current $I_L$ is alternately and iteratively increased and decreased and, macroscopically, the drive current $I_L$ is maintained at a value needed to hold the pressing member 2 at the upper position thereof. Since the resistance of the diode D1 is very small, the potential difference $+V_F$ can be ignored relative to the potential difference $-V_{mm}$.

When the downward-movement command signal is produced from the pedal-operation sensing circuit 4 and the two switching elements Q1, Q2 are switched OFF at a time of $t_C$, the potential difference $V_L$ of the solenoid 1 is inverted with respect to the reference potential and instantaneously increases up to the value of $+V_{mm}$. However, the electric energy of the solenoid 1 quickly dissipates and the drive current $I_L$ flowing through the solenoid 1 instantaneously decreases to zero, so that the work-sheet pressing members 2 are quickly moved downward.

When the pressing members 2 reach the braking position and the photointerrupter 3 is turned OFF, the two switching elements Q1, Q2 are switched ON at a time of $t_D$. Thus, the potential difference $V_L$ across the solenoid 1 is decreased to the value of $-V_{mm}$ and the drive current $I_L$ is increased, so that the downward movement of the pressing member 2 is braked.

After the time duration of $t_2$ seconds elapses, only the second switching element Q2 is switched OFF while the first switching element Q1 is held ON, at a time of $t_E$ ($t_E=t_D+t_2$). Thus, the potential difference $V_L$ becomes equal to the forward voltage $V_F$ of the diode D1. Accordingly, the electric energy stored in the solenoid 1 gradually or slowly dissipates and the drive current $I_L$ flowing through the solenoid 1 slowly decreases. Thus, the pressing member 2 is slowly moved downward toward the work sheet or the upper surface of the throat plate 19.

As is apparent from the foregoing description, the present work-sheet pressing apparatus, or the computer 6 thereof, changes the velocity or speed of downward movement of the work-sheet pressing members 2, when the photointerrupter 3 identifies that the pressing members 2 actually reach the predetermined braking position. Thus, the present apparatus can change the downward-movement speed of the pressing member 2, at the braking position, in each operation. Therefore, even in the case where the downward-movement speed of the pressing member 2 may be changed because of the changes of friction-related parameters on movable components such as the plunger 1*a* of the solenoid 1 and the first to fourth link members 17*a*–17*d* of the link mechanism 17 and/or the changes of respective properties of the electric components of the solenoid drive circuit 7, which result from, e.g., the changes of environmental conditions, cumulative operation time of the present pressing apparatus, aged deteriorations, and/or assembly errors, the present work-sheet pressing apparatus is free from the problem of the low operation efficiency that the speed of downward movement is reduced when the pressing members 2 are moving at a position too far from the throat plate 19, and the problem that the pressing members 2 collide with the throat plate 19 because the speed of downward movement is reduced when the pressing member 2 is moving at a position too near to the throat plate 19.

Referring next to FIG. 6, there is shown another solenoid drive circuit 57 employed in another work-sheet pressing apparatus as a second embodiment of the present invention. The drive circuit 57 may be used in place of the drive circuit 7 shown in FIG. 2. The drive circuit 57 includes an electric power source $V_{mm}$, a solenoid L, a switching element Q, a diode D, and a resistance R. In the solenoid drive circuit 57 arranged as shown in FIG. 6, the solenoid L is switched between an energized and a deenergized state thereof, when the microcomputer 6 switches the switching element Q between an ON and an OFF state thereof, respectively.

The downward movement of the work-sheet pressing members 2 are carried out by controlling the solenoid drive circuit 57 in the following manner: First, the switching element Q is switched OFF and the solenoid L is deenergized. Thus, the pressing members 2 begin a fast downward movement. When the pressing members 2 reach the braking position and the photointerrupter 3 is turned OFF, the switching element Q is switched ON. Thus, a drive current $I_L$ flows through the solenoid L, and the downward movement of the pressing members 2 are braked. Subsequently, the solenoid L is alternately and iteratively deenergized and energized by utilizing the above-described voltage-chopping control of the ON and OFF states of the switching element Q. Thus, the drive current $I_L$ flowing through the solenoid L is chopped and the pressing members 2 are slowly moved downward. It is preferred that the time duration of the first energization of the solenoid L at the transition from the fast downward movement of the pressing members 2 to the slow downward movement be longer by an appropriate time than those of the following energizations, for the purpose of quickly braking the fast downward movement of the pressing member 2 against the downward-direction inertia force of the same 2. The duty cycle of the following deenergizations and energizations of the solenoid L is predetermined at a value suitable for the slow downward movement of the pressing members 2. Thus, the second work-sheet pressing apparatus including the solenoid drive circuit 57 shown in FIG. 6 enjoys the same advantages of the first pressing apparatus including the solenoid drive circuit 7 shown in FIG. 3. In either case, the speed of downward movement of the work-sheet pressing members 2 is changed when the pressing members 2 actually reach the predetermined braking position and accordingly the photointerrupter 3 is turned OFF. The braking position does not change or move even if the speed of downward movement of the pressing member 2 may be changed for various reasons as described above.

Figure 7:
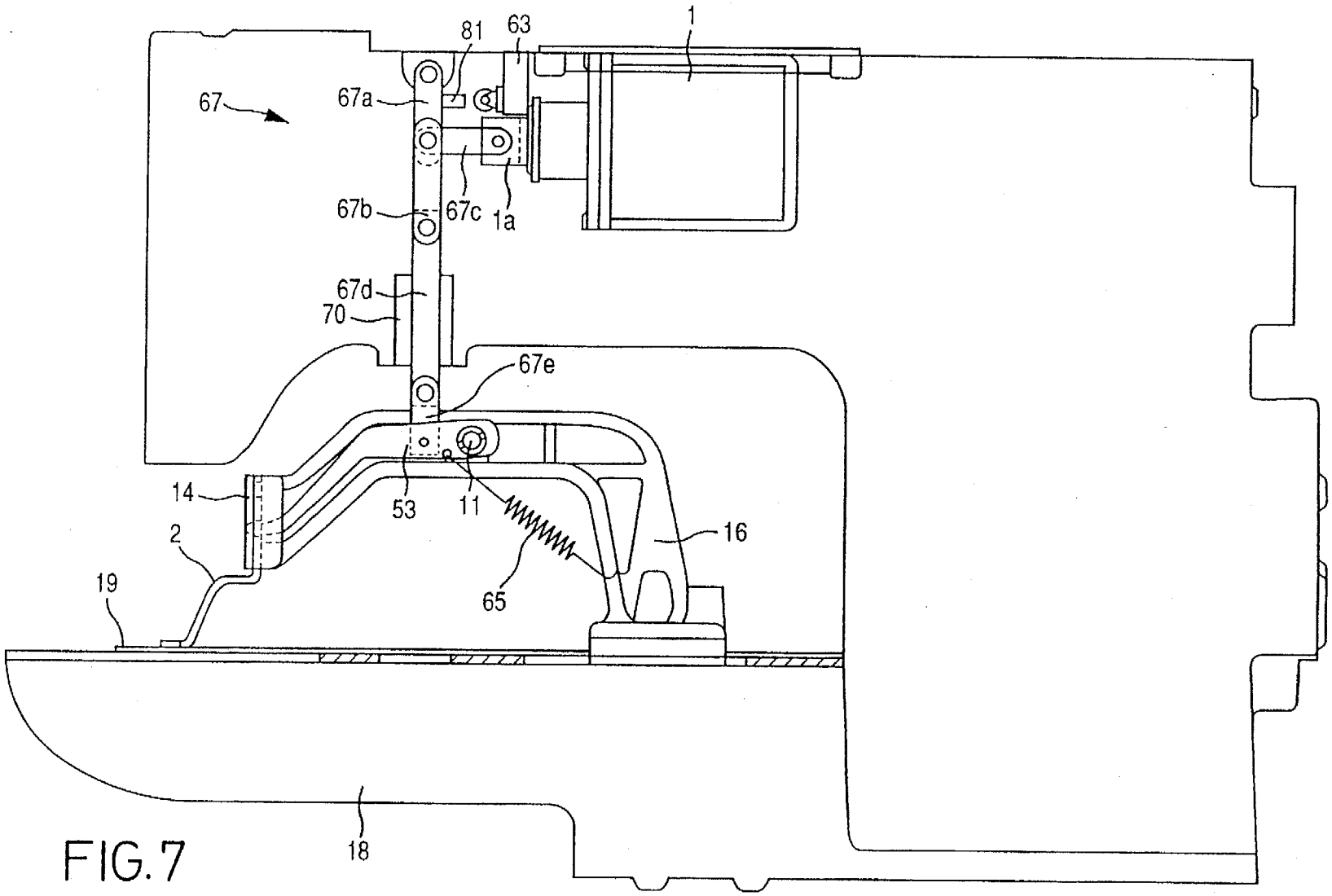
FIG. 7 is a schematic view corresponding to FIG. 1, showing another sewing machine including another work-sheet pressing apparatus as a third embodiment of the present invention.

Referring next to FIG. 7, there is shown a third embodiment of the present invention. The same reference numerals as used in FIG. 1 are used to designate the corresponding elements or portions of the third embodiment shown in FIG. 7. The third embodiment also relates to a work-sheet pressing apparatus, and is different from the work-sheet pressing apparatus as the first embodiment shown in FIG. 1 only with respect to the following points: Two arm members 53 (only one is shown) have respective left arm portions but do not have a right arm portion. A link mechanism 67 includes a first to a fifth link member 67*a* to 67*e*, and connects the arm members 53 to a solenoid 1. The link mechanism 67 provides a toggle mechanism including the first link member 67*a* which is rotatable about a fixed rotation axis, the second link member 67*b* which is connected to the first link member 67*a* such that the second link member 67*b* is rotatable relative to the first link member 67*a*, about a movable rotation axis located away from the fixed rotation axis, and the third link member 67*c* which is connected to the first and second link members such that the third link member 67*c* is rotatable relative to the first and second link members 67*a*, 67*b*, about the movable rotation axis. The second link member 67*b* is rotatably connected to the fourth link member 67*d* which is guided by a link guide member 70 such that the link member 67*d* is movable in a vertical direction. The fourth link member 67*d* is rotatably connected to the fifth link member 67*e* which is rotatably connected to a connection pin which connects between the two arm members 53. The first and second link members 67*a*, 67*b* are connected to each other so as to contain an obtuse angle. The third link member 67*c* extends in a direction substantially perpendicular to a straight line connecting between the fixed rotation axis and an end of the second link member 67*b* at which the second link member 67*b* is rotatably connected to the fourth link member 67*d*. The third link member 67*c* is rotatably connected to the plunger 1*a*. The obtuse angle defined by the first and second link members 67*a*, 67*b* on the left-hand side of the link mechanism 67 is reduced when the plunger la of the solenoid 1 is electromagnetically moved rightward upon energization of a coil of the solenoid 1. A movable member 81 fixed to the first link member 67*a* is movable relative to a limit switch 63. When work-sheet pressing members 2 are moved upward to a predetermined braking position, the movable member 81 contacts a roller of the limit switch 63 and the switch 63 is turned ON. A tension coil spring 65 produces a biasing force to move the pressing members 2 downward toward a throat plate 19 or an upper surface of a sewing bed 18.

The first and second link members 67*a*, 67*b* which are extended straightly as shown in FIG. 7 can be moved rightwardly with a very small force owing to the nature of the toggle mechanism 67*a*, 67*b*, 67*c*. That is, the third link member 67*c* can be moved rightwardly together with the plunger 1*a* with a very small electromagnetic force produced by the solenoid 1. As the third link member 67*c* is moved rightwardly, the electromagnetic force needed to move the plunger 1*a* gradually increases. In the state shown in FIG. 7, the plunger 1*a* is located at an advanced position thereof away from a retracted position thereof corresponding to an upper position of the work-sheet pressing members 2. When the plunger 1*a* is positioned at the advanced position, the solenoid 1 can produce only the smallest force and, when the plunger 1*a* is positioned at the retracted position, the solenoid 1*a* can produce the greatest force. In the present embodiment, since the above-described nature of the toggle mechanism 67*a*, 67*b*, 67*c* and the above-described nature of the solenoid 1 cooperate with each other, a considerably small electromagnetic force can suffice for moving the plunger 1*a* all through the entire stoke from the advanced position to the retracted position.

While the present invention has been described in its preferred embodiments, it is to be understood that the present invention may otherwise be embodied.

For example, in the first embodiment shown in FIG. 1, the photointerrupter 3 and the shutter member 21 are used as a detector which identifies that the work-sheet pressing members 2 have reached the predetermined braking position. However, the detector may otherwise be provided by various sensors such as the limit switch 63 shown in FIG. 7. Above all, the photointerrupter 3 enjoys the advantages that it can detect the movement of the movable elements 2, 13, 17 without needing any contact therewith and that it is considerably cheap.

It is to be understood that the present invention may be embodied with other changes, improvements, and modifications that may occur to those skilled in the art without departing from the spirit and scope of the invention defined in the appended claims.

What is claimed is:

1. An apparatus for moving a work-sheet pressing member of a sewing machine relative to a work-sheet supporting member to press a work sheet on the work-sheet supporting member, the apparatus comprising:

a biasing device which produces a biasing force to move said work-sheet pressing member in a downward direction toward said work-sheet supporting member;

a solenoid which moves, against said biasing force, said work-sheet pressing member in an upward direction away from said work-sheet supporting member;

a control device which controls an energization of said solenoid so that said work-sheet pressing member is moved in said downward and upward directions;

a detector which provides a detection signal indicating that said work-sheet pressing member is moved in said downward direction to a braking position which is predetermined relative to said work-sheet supporting member, said control device receiving said detection signal from said detector; and said control device controlling said solenoid such that, when the control device receives said detection signal during the downward movement of said work-sheet pressing member, the solenoid reduces a speed of said downward movement of the work-sheet pressing member.

2. An apparatus according to claim 1, wherein said control device comprises a deenergizing device which deenergizes said solenoid and thereby permits said work-sheet pressing member to be moved in said downward direction because of said biasing force of said biasing device.

3. An apparatus according to claim 2, wherein said control device comprises a switching device which, when the control device receives said detection signal, energizes said solenoid, subsequently deenergizes the solenoid, and repeats the energization and deenergization of the solenoid by a predetermined number of times.

4. An apparatus according to claim 3, wherein said switching device comprises energization changing means for energizing said solenoid for a first ON time at at least one time immediately after said control device receives said detection signal, and energizing the solenoid for a second ON time shorter than said first ON time, at at least one time following said at least one time immediately after said control device receives said detection signal.

5. An apparatus according to claim 4, wherein said energization changing means comprises means for energizing said solenoid for a predetermined first ON time at at least one time immediately after said control device receives said detection signal, and energizing the solenoid for a predetermined second ON time at each of subsequent times following said at least one time, said first ON time being longer than said second ON time.

6. An apparatus according to claim 3, wherein said control device comprises a solenoid drive circuit which drives said solenoid, said drive circuit comprising an electric power source and a switching element which are connected to the solenoid, said switching device comprising said switching element.

7. An apparatus according to claim 2, wherein said control device comprises a solenoid drive circuit which drives said solenoid, said drive circuit comprising an electric power source, a first switching element connected at a first terminal thereof to ground and at a second terminal thereof to the solenoid, a second switching element connected at a first terminal thereof to said power source and at a second terminal thereof to the solenoid, a first rectifying element connected at a first terminal thereof to said first terminal of said first switching element and at a second terminal thereof to said second terminal of said second switching element, and a second rectifying element connected at a first terminal thereof to said first terminal of said second switching element and at a second terminal thereof to said second terminal of said first switching element.

8. An apparatus according to claim 7, wherein said control device comprises means for deenergizing said solenoid by placing each of said first and second switching elements in an OFF state thereof, and means for, when the control device receives said detection signal, energizing said solenoid by placing each of said first and second switching elements in an ON state thereof for a predetermined ON time, and subsequently placing one of the first and second switching elements in the OFF state thereof while maintaining the other switching element in the ON state thereof.

9. An apparatus according to claim 1, wherein said detector comprises a movable member which is moved together with said work-sheet pressing member when the pressing member is moved in said downward direction, and a non-contact switch which identifies, without mechanically contacting the movable member, that the movable member is moved to a predetermined switching position corresponding to said braking position.

10. An apparatus according to claim 9, wherein said movable member comprises a shutter member which is moved together with said work-sheet pressing member when the pressing member is moved in said downward direction, and said non-contact switch comprises a photointerrupter, which includes a light emitter for emitting a light, and a light receiver for receiving said light emitted from said light emitter, wherein when said shutter member is moved to said predetermined switching position corresponding to said braking position, the shutter member interrupts said light emitted from said light emitter toward said light receiver, so that said photointerrupter produces said detection signal.

11. An apparatus according to claim 1, wherein said detector comprises a movable member which is moved together with said work-sheet pressing member when the pressing member is moved in said downward direction, and a contact switch which identifies, by mechanically contacting the movable member, that the movable member is moved to a predetermined switching position corresponding to said braking position.

12. An apparatus according to claim 1, further comprising an arm member and an axis member about which said arm member is rotatable, said work-sheet pressing member being supported by said arm member.

13. An apparatus according to claim 12, wherein said biasing device comprises a coil spring which is connected to said arm member.

14. An apparatus according to claim 13, wherein said arm member includes two arm portions located on both sides of said axis member and said work-sheet pressing member is supported by one of said two arm portions of said arm member, and wherein said coil spring comprises a compression coil spring connected to the other arm portion of said arm member.

15. An apparatus according to claim 13, wherein said coil spring comprises a tension coil spring which is connected to said arm member at an intermediate position between a position where said axis member is provided and a position where said work-sheet pressing member is supported by the arm member.

16. An apparatus according to claim 12, further comprising a link mechanism which connects said arm member to said solenoid, said link mechanism comprising a direction-changing mechanism including a first link member which is rotatable about a fixed rotation axis, a second link member which is connected to said first link member such that said second link member is rotatable relative to the first link member, about a first movable rotation axis located away from said fixed rotation axis, and a third link member which is connected to at least one of said first and second link members such that said third link member is rotatable relative to said at least one of the first and second link members, about a second movable rotation axis, said second link member being rotatably connected to said arm member, said first and second link members being connected to each other so as to contain an obtuse angle inside of which said third link member extends in a direction substantially perpendicular to a straight line connecting between said fixed rotation axis and an end of said second link member at which the second link member is rotatably connected to said arm member, wherein said solenoid comprises a coil and a plunger which is electromagnetically moved relative to said coil when the coil is energized by said control device, said third link member being rotatably connected to said plunger.

17. An apparatus according to claim 16, wherein said link mechanism further comprises a guide member and a fourth link member which is rotatably connected at one of opposite ends thereof to said second link member, is rotatably connected at the other end thereof to said arm member, and is moved with the second link member by being guided by said guide member.

18. An apparatus according to claim 17, wherein said detector comprises a movable member which is moved together with one of said first, second, third, and fourth link members when said work-sheet pressing member is moved in said downward direction, and a switch which identifies that said movable member is moved to a predetermined switching position corresponding to said braking position.

19. An apparatus according to claim 12, further comprising a link mechanism which connects said arm member to said solenoid, said link mechanism comprising a toggle mechanism including a first link member which is rotatable about a fixed rotation axis, a second link member which is connected to said first link member such that said second link member is rotatable relative to the first link member, about a first movable rotation axis located away from said fixed rotation axis, and a third link member which is connected to at least one of said first and second link members such that said third link member is rotatable relative to said at least one of the first and second link members, about a second movable rotation axis, said second link member being rotatably connected to said arm member, said first and second link members being connected to each other so as to contain an obtuse angle which is reduced when said solenoid is energized, said third link member extending in a direction substantially perpendicular to a straight line connecting between said fixed rotation axis and an end of said second link member at which the second link member is rotatably connected to said arm member, wherein said solenoid comprises a coil and a plunger which is electromagnetically moved relative to said coil when the coil is energized by said control device, said third link member being rotatably connected to said plunger.

20. An apparatus according to claim 1, further comprising an input device, which is operable for inputting a command to move said work-sheet pressing member in said downward direction.

* * * * *